US005313805A

United States Patent [19]

Blackmon et al.

[11] Patent Number: 5,313,805

[45] Date of Patent: May 24, 1994

[54] APPARATUS AND METHOD FOR PURGING A REFRIGERATION SYSTEM

[75] Inventors: William S. Blackmon; John G. Blackmon, both of Charlotte, N.C.

[73] Assignee: Carolina Products, Inc., Charlotte, N.C.

[21] Appl. No.: 27,708

[22] Filed: Mar. 8, 1993

[51] Int. Cl.[5] ..... F25B 43/04

[52] U.S. Cl. ..... 62/195; 62/475

[58] Field of Search ..... 62/85, 195, 475, 292, 62/149

[56] References Cited

U.S. PATENT DOCUMENTS

| | | | |
|---|---|---|---|
| 3,664,147 | 5/1972 | Blackmon | 62/85 |
| 4,984,431 | 1/1991 | Mount et al. | 62/85 |
| 5,241,837 | 9/1993 | Albertson, III | 62/195 |

*Primary Examiner*—John M. Sollecito
*Attorney, Agent, or Firm*—Louis T. Isaf

[57] ABSTRACT

Provided is a purge apparatus for removing foreign non-condensable gases from a refrigeration system. The purge apparatus includes a closed purge chamber adapted to receive foreign gases together with a portion of the refrigerant from the high pressure region of the refrigeration system. The purge chamber is cooled to condense the refrigerant. During a Purge Mode, the purge chamber is isolated from the refrigeration system, and gases and a portion of the refrigerant in the purge chamber are vented to a gas separation tank. Adsorbent material in the gas separation tank adsorbs refrigerant and the other gasses are vented from the gas separation tank to the atmosphere. During a Quiet Mode, condensed refrigerant is drawn from the purge chamber to the low pressure portion of the refrigerant system, and a vacuum is drawn on the gas separation tank and the gas separation tank is heated to draw refrigerant from the adsorbent material. The gas separation tank is heated by a coil through which gasses from the high pressure portion of the refrigeration system pass on their way to the purge chamber, where the gasses are further cooled. Thus, an energy efficient heat source that is essentially free is utilized to heat the gas separation tank.

15 Claims, 2 Drawing Sheets

APPARATUS AND METHOD FOR PURGING A REFRIGERATION SYSTEM

BACKGROUND OF THE INVENTION

The present invention relates to a refrigeration system, and more particularly to an apparatus and method for purging non-condensable gases from a refrigeration system.

In a conventional refrigeration system, particularly in low pressure centrifugal compressor systems, the leakage of air, water vapor, and other contaminating foreign gases into the system is a recognized problem. Such gases reduce the efficiency of the system since they tend to elevate the total pressure in the condenser, and thus more power is required from the compressor per unit of refrigeration. Also, these foreign gases tend to cling to the condenser tubes thereby reducing the total condensing surface area.

To remove these foreign gases from the system, it is common practice to draw a mixture of the gaseous refrigerant and foreign gases from the high pressure region in the condenser or receiver where they normally accumulate, condense the refrigerant and any water vapor by cooling or by compression and cooling, vent off the non-condensables, separate and drain the water, and return the condensed refrigerant to the low pressure region of the system. Typically a purge apparatus is used to remove foreign gases from the refrigeration system in the above manner. A conventional purge apparatus typically comprises a purge chamber wherein the non-condensables gather above the liquid refrigerant and water. A pressure actuated mechanical relief valve automatically opens to vent the non-condensables to the atmosphere through a gas discharge line, and a manual drain is provided to drain off the water which floats on top of the liquid refrigerant. A mechanical valve adjacent the bottom of the purge chamber is opened by a float to drain the condensed refrigerant through a refrigerant line and return it to the low pressure region of the system.

While conventional purge apparatuses are efficient, it is recognized that non-condensed refrigerant remains with the contaminating non-condensable gases in the purge chamber and is vented to the atmosphere through the gas discharge line during the purging operation. Modern purge apparatuses include many refinements and, as a result, are more efficient than conventional purge apparatuses. However, it is recognized that even modern purge apparatuses vent some refrigerant to the atmosphere. Refrigerant that is vented to the atmosphere may adversely affect the environment. Also, each time refrigerant is vented to the atmosphere, the amount of refrigerant contained in the refrigeration system is decreased; therefore, after some period of time, refrigerant must be added to the refrigeration system to replace that which has been vented to the atmosphere.

There is a need, therefore, for a purge apparatus and method that substantially eliminates the venting of refrigerant to the atmosphere.

SUMMARY OF THE INVENTION

Briefly described, the present invention comprises an improved purge apparatus which, in its most preferred embodiment, includes a closed purge chamber, a mixed gas inlet line connected between the high pressure region of a refrigeration system and the purge chamber for introducing refrigerant and any non-condensable gases from the high pressure region into the purge chamber, and means for cooling the purge chamber to at least substantially condense the refrigerant therein. A refrigerant line is provided for periodically discharging a portion of the condensed refrigerant from the purge chamber, through a valve, to the low pressure region of the refrigeration system. A gas discharge line is provided for periodically discharging non-condensable gases from the purge chamber. The gas discharge line passes through a valve and is in fluid communication with a gas separation tank.

An adsorbent material is disposed in the gas separation tank. Also, a portion of the mixed gas inlet line passes through and heats the gas separation tank; this is a substantially free heat source. A vent line extends from, and is in fluid communication with, the gas separation tank. The vent line extends through a valve and then provides a vent path to the atmosphere. A recycle line extends from the gas separation tank and through a valve to the low pressure region of the refrigeration system.

A float actuated electrical switch is provided within the purge chamber. It is responsive to the level of condensed refrigerant within the purge chamber and cooperates with a relay and solenoids to properly operate the above mentioned valves. The float actuated electrical switch, in cooperation with the relay, solenoids and valves, causes the purge apparatus to operate successively in a Purge Mode and a Quiet Mode.

During the Purge Mode, condensed refrigerant collected in the bottom of the purge chamber does not flow through the refrigerant line to the low pressure region of the refrigeration system. Likewise, there is no fluid communication between the gas separation tank and the low pressure region of the refrigeration system. Non-condensable gases which have accumulated above the liquid level in the purge chamber are drawn through the gas discharge line, the separation tank and the vent line, and are discharged to the atmosphere. It is recognized, however, that the purge chamber may not condense all of the refrigerant that is drawn into it, and thus a small amount of the non-condensed refrigerant may move with the non-condensable gases through the gas discharge line and into the gas separation tank. The adsorbent material adsorbs refrigerant that is within the gas separation tank.

In the Quiet Mode, condensed refrigerant collected in the bottom of the purge chamber flows through the refrigerant line to the evaporator of the refrigeration system. The gas separation tank is not in fluid communication with the purge chamber through the gas discharge line or the atmosphere through the vent line. The gas separation chamber is in fluid communication with the low pressure region of the refrigeration system through the recycle line. The pressure differential between the low pressure region of the refrigeration system, in conjunction with the heating of the gas separation tank, causes refrigerant to be drawn and driven from the adsorbent material to the low pressure region of the refrigeration system. As refrigerant is drawn from the adsorbent material, the capacity of the adsorbent material to adsorb refrigerant is increased. Therefore, the adsorbent material is readied for the subsequent Purge Mode in which it adsorbs refrigerant.

It is therefore an object of the present invention to further improve the efficiency of a purge apparatus of the described type by substantially eliminating the venting of any non-condensed refrigerant to the atmosphere during the purging operation.

Another object of the present invention is to provide a purge apparatus of the described type which is economical to manufacture and which is effective and efficient in use.

Yet another object of the object of the present invention is to utilize a substantially free heat source.

Still another object of the present invention is to utilize the mixed gas inlet line for heating purposes.

Still another object the present invention is to pass a portion of the mixed gas inlet line through the gas separation tank so that the hot gasses passing through the mixed gas inlet line heat the gas separation tank.

Still another object the present invention is to pass a portion of the mixed gas inlet line through the gas separation tank so as to cool the hot gasses passing through the mixed gas inlet line.

Other objects, features and advantages of the present invention will become apparent upon reading and understanding this specification, taken in conjunction with the accompanying drawing.

DETAILED DESCRIPTION OF THE PREFERRED EMBODIMENT

Figure 1:
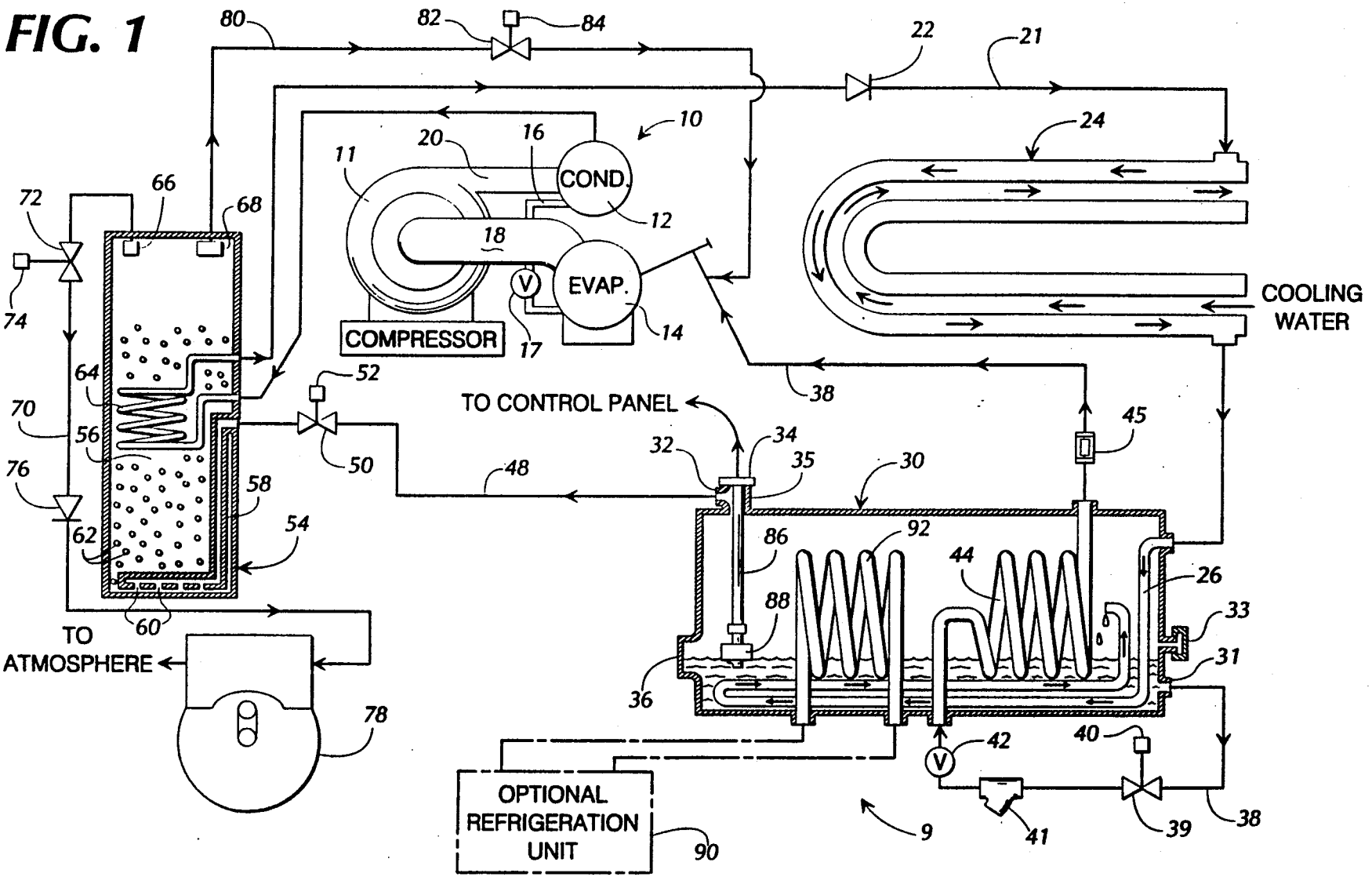
FIG. 1 is a partially cross-sectional, schematic illustration of a conventional refrigeration system incorporating the improved purge apparatus of the present invention, in accordance with the preferred embodiment of the present invention.

Referring now in greater detail to the drawing, in which like numerals represent like components throughout the several views, FIG. 1 shows a partially cross-sectional, schematic illustration of a refrigeration and purge system 9, including a conventional refrigeration system 10 incorporating the improved purge apparatus of the present invention, in accordance with the preferred embodiment of the present invention. The conventional refrigeration system 10 includes a centrifugal compressor 11, a condenser 12, and a cooler or evaporator 14. A line 16 conducts the condensed refrigerant between the condenser 12 and the evaporator 14, and the line 16 includes a conventional restriction or expansion valve 17, which divides the system into a high pressure region in the condenser 12 and a low pressure region in the evaporator 14. A line 18 provides a path of flow for the gaseous refrigerant formed in the evaporator 14 to the compressor 11, where the pressure of the refrigerant is elevated. The pressurized gaseous refrigerant is then discharged through line 20 to the condenser 12 to complete the refrigeration cycle.

Since the low pressure region of the above described refrigeration system 10 is commonly below atmospheric pressure, it is subject to air-in leakage. The water vapor and non-condensable gases which enter with the air collect in the upper portion of the condenser 12 and mix with the gaseous refrigerant. The purge apparatus, which includes a condensing apparatus 24, purge chamber 30, gas separation tank 54, and the components associated therewith, effectively extracts the water vapor and non-condensable gases from the refrigeration system 10. A mixed gas inlet line 21 is provided for removing water vapor, non-condensable gases, and gaseous refrigerant from the condenser 12. The mixed gas inlet line 21 includes a check valve 22 and it leads through a condensing apparatus 24 where the refrigerant and water vapor are at least partially condensed. The condensing apparatus 24 may be supplied with cooling water or other cooling medium to facilitate the cooling operation. From the condensing apparatus 24, the mixed gas inlet line 21 leads to a tube 26 positioned within the interior of the purge chamber 30, and the tube 26 opens into the interior of the purge chamber 30.

The purge chamber 30 comprises a closed vessel which may, for example, be in the configuration of an elongated tubular member with closed parallel opposite ends. The outer walls are preferably covered with a heat insulating material (not shown) to reduce heat transfer.

The refrigerant and water vapor passing through the mixed gas inlet line 21 and tube 26 will have been at least partially condensed in the condensing apparatus 24, and thus these components will enter the purge chamber 30 essentially in liquid form and collect at the bottom thereof. The water, being lighter than the condensed refrigerant, will float on top. The non-condensable gases entering the purge chamber 30 will collect in the upper region thereof.

The purge chamber 30 includes a first outlet 31 adjacent the bottom for draining the condensed refrigerant therefrom, a second outlet 32 adjacent the top for venting the non-condensable gases, and a third outlet 33 positioned at a level intermediate the first and second outlets for discharging any water floating on the top of the refrigerant. A manually removable cap 34 is operatively positioned to close a further outlet 35 and mount a float switch in the purge chamber 30 as further described below. Also, the purge chamber 30 may include a sight glass 36 in one end wall for the purposes described below.

The first outlet 31 of the purge chamber 30 is connected to a refrigerant line 38 which leads through a first valve 39 controlled by the first solenoid 40, through a strainer 41, and then through a restriction or expansion valve 42. The line 38 then fluidly communicates with a coil 44 positioned within the purge chamber 30, and the line 38 then exits the purge chamber 30 and continues to the evaporator 14 of the refrigeration system 10. The line 38 may include a sight glass 45 downstream of the purge chamber 30.

The second outlet 32 adjacent the top of the purge chamber 30 is connected to a gas discharge line 48 that is in communication with interior of the purge chamber 30. The gas discharge line 48 passes through a second valve 50 controlled by a second solenoid 52, and is connected to the gas separation tank 54. The gas separation tank 54 of the preferred embodiment is in the form of an upright cylindrical tube having closed upper and lower ends, and defines a separation cavity 56. The gas discharge line 48 fluidly communicates with an internal tube 58 at about the midportion of the height of the separation tank 54. The internal tube 58 is disposed within the separation cavity 56 and extends downwardly to a location adjacent the bottom of the tank where it defines tube openings 60.

Adsorbent material 62, which is capable of selectively adsorbing and releasing refrigerant in the manner discussed below, is disposed within the separation cavity 56. For example, in the illustrated embodiment (FIG. 1) the separation cavity 56 is filled to a height of about two-thirds of the height of the gas separation tank 54 with the adsorbent material 62. An acceptable adsorbent material 62 is granulated carbon. Also disposed within the separation cavity 56 is a tube coil 64, which forms a portion of the mixed gas inlet line 21. For example, in the illustrated embodiment (FIG. 1) the tube coil 64 is positioned at about the midportion of the height of the separation tank 54. Since relatively hot pressurized gases flow through the mixed gas inlet line 21 and thus the coil 64, the gas separation tank 54 is thereby heated. This provides an energy efficient heat source that is essentially free, since the gases in the mixed gas inlet line 21 must in any event be cooled. Passing the gasses through the coil 64 also serves to assist in the cooling of the gasses passing through the mixed gas inlet line 21. The tank 54 is also preferably covered with a heat insulating material (not shown) to reduce heat transfer to the surrounding air.

The gas separation tank 54 defines a vent port 66 and a recycle port 68, each of which provide access to the separation cavity 56. A vent line 70 is connected to the vent port 66 and fluidly communicates therethrough with the separation cavity 56. The vent line 70 leads through a third valve 72 which is controlled by a third solenoid 74, then through a check valve 76, and finally through an air pump 78 and to the atmosphere. A recycle line 80 is connected to the recycle port 68 and fluidly communicates therethrough with the separation cavity 56. The recycle line 80 leads through a fourth valve 82 which is controlled by a fourth solenoid 84 and attaches to and fluidly communicates with the refrigerant line 38.

Positioned within the purge chamber 30 is a float actuated electric switch 86 which is controlled by the level of condensed refrigerant and water in the purge chamber 30, and includes a magnet equipped float 88. The electric switch 86 cooperates with a relay (FIG. 2) to control the opening and closing of the valves 39,50,72,82 and operation of the air pump 78.

Figure 2:
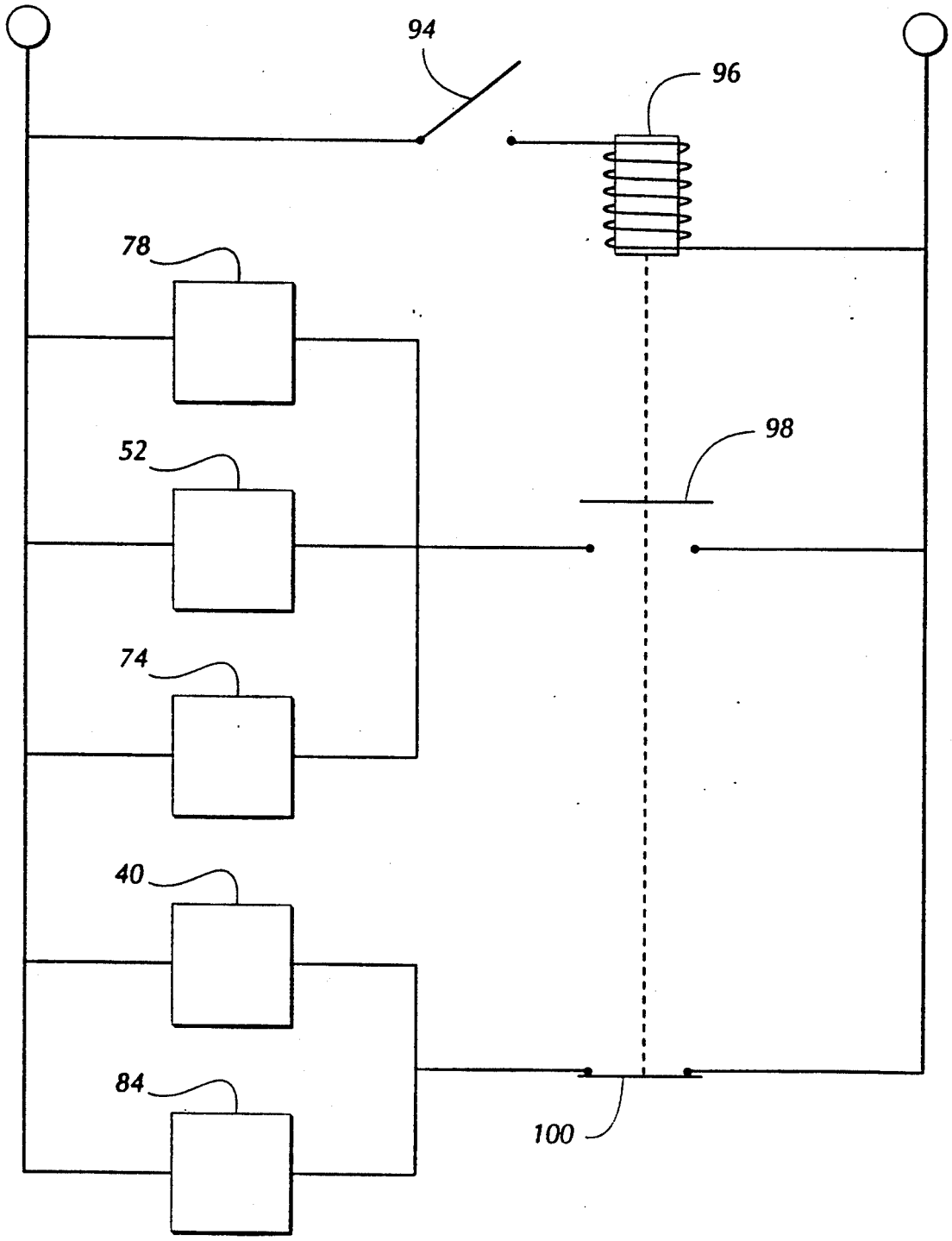
FIG. 2 is a schematic wiring diagram of a portion of the improved purge apparatus, in accordance with the preferred embodiment of the present invention.

Referring to FIG. 2, which is a schematic wiring diagram of a portion of the purge apparatus in accordance with the preferred embodiment of the present invention, the float actuated electric switch 86 (FIG. 1) includes a switch contact 94. The switch contact 94 is disposed within the float actuated electric switch 86 and biased toward an open configuration. The switch contact 94 is controlled by the magnet equipped float 88 (FIG. 1), which is designed to cause the switch contact 94 to close. The switch contact 94 actuates a relay 96 that is operatively connected to a first contact switch 98 and a second contact switch 100.

Referring back to FIG. 1, in an alternate embodiment of the present invention, the purge apparatus further includes a separate refrigeration unit 90 which has an evaporator coil 92 positioned within the purge chamber 30. The additional cooling capacity provided by this separate refrigeration unit 90 assures maximum condensation of the refrigerant in the purge chamber 30.

In operation, the purge chamber 30 receives the partially condensed refrigerant and water vapor, as well as the non-condensable gases, from the mixed gas inlet line 21. The condensed refrigerant and water collect at the bottom of the purge chamber 30. When the level of the condensed refrigerant and water in the purge chamber 30 is above a predetermined level, the purge apparatus operates in a "Quiet Model". Referring to FIG. 2, during the Quiet Mode, the magnetic equipped float 88 does not affect the switch contact 94, and therefore the switch contact 94 is open. While the switch contact 94 is open, the relay 96 is de-energized and the first contact switch 98 is open and the second contact switch 100 is closed. When the first contact switch 98 is open, the air pump 78 is not operating, the second solenoid 52 is de-energized to close the second valve 50 (FIG. 1), and the third solenoid 74 is de-energized to close the third valve 72 (FIG. 1). When the second contact switch 100 is closed, the first solenoid 40 is energized to open the first valve 39 (FIG. 1), and the fourth solenoid 84 is energized to open the fourth valve 82 (FIG. 1).

Referring back to FIG. 1, when the level of the condensed refrigerant and water in the purge chamber 30 is at or below the predetermined level, the purge apparatus operates in a "Purge Model". Referring back to FIG. 2, during the Purge Mode, the magnetic equipped float 88 causes the switch contact 94 to be closed and the relay 96 to be energized. When the relay 96 is energized, the first contact switch 98 is closed and the second contact switch 100 is open. When the first contact switch 98 is closed, the air pump 78 is operating, the second solenoid 52 is energized to open the second valve 50 (FIG. 1), and the third solenoid 74 is energized to open the third valve 72 (FIG. 1). When the second contact switch 100 is open, the first solenoid 40 is de-energized to close the first valve 39 (FIG. 1), and the fourth solenoid 84 is de-energized to close the fourth valve 82 (FIG. 1).

Referring back to FIG. 1, as specified above, during the Quiet Mode the first valve 39 is open, the second valve 50 is closed, the third valve 72 is closed, the fourth valve 82 is open, and the air pump 78 is not operating. Since the first valve 39 is open, condensed refrigerant collected in the bottom of the purge chamber 30 flows through the refrigerant line 38 and the expansion valve 42 and into the coil 44 located within the purge chamber 30. The expansion valve 42 causes the pressure to drop within the coil 44 to approximately the pressure in the low pressure region of the refrigeration system 10, and the refrigerant therein to evaporate. This in turn cools the interior of the purge chamber 30, lowering its temperature to approach that of the evaporator 14, and causing refrigerant and water vapor not previously condensed in the purge chamber 30 to be condensed. The evaporated refrigerant in the coil 44 is returned to the evaporator 14 of the refrigeration system 10 via the remainder of the refrigerant line 38.

Since the second valve 50 and third valve 72 are closed during the Quiet Mode, the gas separation tank 54 is not in fluid communication with the purge chamber 30 or atmosphere. As discussed below, during Purge Mode the adsorbent material 62 adsorbs refrigerant. During the Quiet Mode, refrigerant previously adsorbed by the adsorbent material 62 is drawn and driven from the adsorbent material 62 to the evaporator 14. Since the fourth valve 82 is open, the gas separation tank 54 is fluidly communicating with the evaporator 14 via the recycle line 80 and the refrigeration line 38. The evaporator 14, as discussed above, is commonly below atmospheric pressure, therefore it draws a vacuum on the gas separation tank 54, and refrigerant is drawn from the adsorbent material 62 to the evaporator 14. Also as discussed above, hot pressurized gasses flow from the condenser 12 through the tube coil 64, whereby the gas separation tank 54 is heated. This provides an energy efficient heat source that is essentially free, since the gases in the mixed gas inlet line 21 must in any event be cooled. The heating of the gas separation tank 54 drives refrigerant from the adsorbent material 62 and therefore aids in the drawing of refrigerant from the adsorbent material 62 to the evaporator 14. As refrigerant is drawn from the adsorbent material 62 to the evaporator 14, the capacity of the adsorbent material 62 to adsorb refrigerant is increased. Therefore, the adsorbent material 62 is readied for the subsequent Purge Mode, during which it adsorbs refrigerant in the manner discussed below.

During the Quiet Mode, non-condensable gasses collect in the upper portion of the purge chamber 30 and force the level of condensed refrigerant and water collected in the bottom of the purge chamber 30 to decrease until the magnet equipped float 88 drops to a level sufficient to trigger switch 86 (as described above) to place the purge system in the Purge Mode. As specified above, during the Purge Mode the first valve 39 is closed, the second valve 50 is open, the third valve 72 is open, the fourth valve 82 is closed, and the air pump 78 is operating. Since the first valve 39 is closed, condensed refrigerant collected in the bottom of the purge chamber 30 does not flow to the evaporator 14 through the refrigerant line 38. Likewise, since the fourth valve 82 is closed, there is no direct fluid communication between the separation cavity 56 of the gas separation tank 54 and the evaporator 14.

Since the second valve 50 and third valve 72 are open, and the air pump 78 is operating during the Purge Mode, the non-condensable gases which have accumulated above the liquid level in the purge chamber 30 are drawn through the gas discharge line 48, the separation tank 54 and the vent line 70, and are discharged to the atmosphere. It is recognized, however, that the purge chamber 30 may not condense all of the refrigerant that is drawn into it, and thus a small amount of the non-condensed refrigerant may move with the non-condensable gases through the gas discharge line 48 and into the gas separation tank 54 where it comes into contact with the adsorbent material 62. As discussed above, during the Quiet Mode refrigerant is drawn from the adsorbent material 62, therefore, during the Purge Mode the adsorbent material 62 is capable of adsorbing refrigerant. Thus, preferably, substantially all of the refrigerant that passes into the gas separation tank 54 with the non-condensable gases from the purge chamber 30 is adsorbed by the adsorbent material 62.

As gasses are vented from the purge chamber 30 during Purge Mode, the pressure in the purge chamber 30 is lowered which tends to cause more refrigerant to flow into the purge chamber 30 from the inlet line 21. This additional refrigerant tends to raise the refrigerant level and thus cause the purge system to go into the Quiet Mode. Thus, the Purge Mode occurs in very brief intervals. The length of the intervals depends upon the amount of air leakage into the refrigeration system 10, and intervals may, for example, be only about ten seconds every few hours.

The water floating on top of the refrigerant within the purge chamber 30 may be periodically drained through the water outlet 33 by manually removing its cap. The sight glass 36 on the end wall of the purge chamber is used to facilitate observation of the water level.

The above described purge system is essentially automatic, and will operate whenever the compressor 11 of the main refrigeration system 10 is running.

In accordance with an alternate embodiment of the present invention, the air pump 78 is not utilized. Since the pressure in the purge chamber 30 is normally above atmospheric pressure, gas in the purge chamber 30 can exhaust to the atmosphere without the air pump 78. However, in accordance with the preferred embodiment of the present invention, the air pump 78 is employed to enhance the venting of non-condensable gasses from the purge chamber 30. Also, where the refrigeration system operates at lower pressures, such as when R-113 refrigerant is utilized, the pressure in the purge chamber 30 may be at or slightly below atmospheric pressure, and in this case, the air pump 78 is employed.

Whereas this invention has been described in detail with particular reference to preferred embodiments and alternate embodiments thereof, it will be understood that variations and modifications can be effected within the spirit and scope of the invention, as described herein before and as defined in the appended claims.

I claim:

1. A purge apparatus for removing non-condensable gases from the refrigerant in a refrigeration system having a relatively high pressure region and a relatively low pressure region, comprising:

a closed purge chamber;

a mixed gas inlet line connected between the high pressure region of the refrigeration system and said purge chamber for introducing refrigerant and any non-condensable gases from the high pressure region into said purge chamber;

means for cooling said purge chamber to at least substantially condense the refrigerant therein;

first outlet means for periodically discharging a portion of the condensed refrigerant from said purge chamber to the low pressure region of the refrigeration system; and second outlet means for periodically discharging any non-condensable gases from said purge chamber to the atmosphere, including, at least, a gas discharge line communicating with said purge chamber and discharging to the atmosphere, and a gas separation tank communicating with said gas discharge line, wherein said mixed gas inlet line is in heat exchange relationship with said gas separation tank.

2. Purge apparatus of claim 1, wherein a portion of said mixed gas inlet line which is positioned within the interior of said gas separation tank.

3. Purge apparatus of claim 1, further comprising an adsorption means for adsorbing refrigerant, wherein said adsorption means is disposed within said gas separation tank.

4. Purge apparatus of claim 3, further comprising a recycle means for drawing refrigerant from said gas separation tank to the relatively low pressure region of the refrigeration system.

5. Purge apparatus of claim 4, wherein said recycle means includes, at least, a recycle line communicating between said gas separation tank and the relatively low pressure region of the refrigeration system.

6. Purge apparatus of claim 5, wherein said gas discharge line includes, at least, a first end and a second end, wherein said gas separation tank communicates with said gas discharge line at a position between said first end and said second end of said gas discharge line, wherein said first end is attached to said purge chamber and said second end vents to the atmosphere, wherein said second outlet means further includes, at least, a first valve positioned along said gas discharge line between said separation tank and said purge chamber, and a second valve positioned along said gas discharge line between said separation tank and said second end of said discharge line, wherein said recycle means further includes, at least, a third valve positioned along said recycle line between said gas separation tank and the relatively low pressure region of the refrigeration system, and wherein said purge apparatus further comprises a switch means disposed within said purge chamber for opening said first valve and said second valve, and closing said third valve when condensed refrigerant within the purge chamber reaches a first predetermined level; and closing said first valve and said second valve, and opening said third valve when condensed refrigerant within the purge chamber reaches a second predetermined level.

7. Purge apparatus of claim 5, further comprising means for cooling said mixed gas inlet line at a location between the high pressure region and said purge chamber so as to at least partially condense the refrigerant passing therethrough.

8. A purge apparatus for removing non-condensable gases from the refrigerant in a refrigeration system having a relatively high pressure region and a relatively low pressure region, comprising:

a closed purge chamber;

a mixed gas inlet line connected between the high pressure region of the refrigeration system and said purge chamber for introducing the refrigerant and any non-condensable gases from the high pressure region into said purge chamber;

means for cooling said purge chamber to at least substantially condense the refrigerant therein;

first outlet means including, at least, a refrigerant line extending from said purge chamber to the low pressure region of the refrigeration system, and a first valve positioned in said refrigerant line;

second outlet means including, at least, a gas discharge line having a first end communicating with said purge chamber and a second end discharging to the atmosphere, a second valve positioned in said gas discharge line between said first end and said second end, a third valve positioned in said gas discharge line between said second valve and said second end, a gas separation tank communicating with said gas discharge line at a location between said second valve and said third valve, recycle means including, at least, a recycle line communicating between said gas separation tank and the relatively low pressure region of the refrigeration system, a fourth valve position in said recycle line, a switch means for selectively closing said first valve, opening said second valve, opening said third valve, and closing said fourth valve to vent gases from said purge chamber, through said gas separation tank, and to the atmosphere, and isolate said refrigerant line; and for selectively opening said first valve, closing said second valve, closing said third valve, and opening said fourth valve to isolate said separation tank from the atmosphere and said purge chamber, to direct condensed refrigerant in said purge chamber to the relatively low pressure region of the refrigeration system when the level of condensed refrigerant in said purge chamber falls below a predetermined level, and to vent from said gas separation tank to the relatively low pressure region of the refrigeration system;

adsorbent means disposed within said gas separation tank for adsorbing refrigerant when gasses are vented from said purge chamber, through said gas separation tank, and to the atmosphere; and for releasing refrigerant when said gas separation tank is vented to the relatively low pressure region of the refrigeration system; and means for utilizing the relatively high pressure region of the refrigeration system to heat said gas separation tank.

9. Purge apparatus of claim 8, wherein said means for utilizing the relatively high pressure region of the refrigeration system to heat said gas separation tank includes, at least, a portion of said mixed gas inlet line which is positioned within the interior of said gas separation tank.

10. Purge apparatus of claim 9, wherein said gas separation tank defines a separation cavity therein, and includes, at least, an internal tube disposed within said separation cavity, wherein said internal tube has a first end in communication with said gas discharge line at about the midportion of said gas separation tank, and a second end adjacent to the bottom of said gas separation tank and defining a plurality of holes through which said gas discharge line is in communication with said separation cavity.

11. Purge apparatus of claim 9, wherein said means for cooling said purge chamber includes, at least, a portion of said refrigerant line which is positioned in heat exchange relationship with the interior of said purge chamber, and an expansion valve positioned in said refrigerant line upstream of said portion thereof, so that the condensed refrigerant passing therethrough expands and adsorbs heat from the interior of said purge chamber.

12. Purge apparatus of claim 11, wherein said means for cooling said purge apparatus further includes, at least, a separately operable refrigeration unit having an evaporator coil positioned in heat exchange relationship with the interior of said purge chamber.

13. Purge apparatus of claim 11, further comprising means for cooling said mixed gas input line at a location between the high pressure region and said purge chamber so as to at least partially condense the refrigerant passing therethrough.

14. Purge apparatus of claim 9, wherein said second outlet means further includes, at least, a gas pump positioned in said gas discharge line downstream of said separation tank.

15. A purge refrigeration system comprising:

a condenser;

an evaporator;

a compressor communicating between said condenser and said evaporator;

an expansion line communicating between said condenser and said evaporator;

a purge means for drawing refrigerant and non-condensable gasses from said condenser, substantially separating the refrigerant and non-condensable gasses, venting the non-condensable gasses to the atmosphere, and discharging refrigerant to said evaporator, and including a gas separation tank; and a multipurpose heat means for utilizing waste heat from said condenser, for heating said gas separation tank, and for providing additional condensation of refrigerant drawn from said condenser.

* * * * *

UNITED STATES PATENT AND TRADEMARK OFFICE

CERTIFICATE OF CORRECTION

PATENT NO. : 5,313,805

DATED : May 24, 1994

INVENTOR(S) : William S. Blackmon; John G. Blackmon

It is certified that error appears in the above-identified patent and that said Letters Patent is hereby corrected as shown below:

Title page, item

(56) References Cited

U.S. PATENT DOCUMENTS

| | | | |
|---|---|---|---|
| 3,664,147 | 5/1972 | Blackmon | 62/85 |
| 4,984,431 | 1/1991 | Mount et al | 62/85 |
| 5,187,953 | 2/1993 | Mount | 62/195 |

Signed and Sealed this

Twentieth Day of September, 1994

*Attest:*

*Attesting Officer*

Bruce Lehman

BRUCE LEHMAN

*Commissioner of Patents and Trademarks*